US008128764B2

(12) United States Patent
Miracle et al.

(10) Patent No.: US 8,128,764 B2
(45) Date of Patent: Mar. 6, 2012

(54) TITANIUM ALLOY MICROSTRUCTURAL REFINEMENT METHOD AND HIGH TEMPERATURE, HIGH STRAIN RATE SUPERPLASTIC FORMING OF TITANIUM ALLOYS

(76) Inventors: Daniel B. Miracle, Bellbrook, OH (US); Seshacharyulu Tamirisakandala, Beavercreek, OH (US); Radhakrishna B. Bhat, Beavercreek, OH (US); Jaimie S Tiley, Verona, OH (US)

( * ) Notice: Subject to any disclaimer, the term of this patent is extended or adjusted under 35 U.S.C. 154(b) by 1158 days.

(21) Appl. No.: 10/581,998

(22) PCT Filed: Dec. 13, 2004

(86) PCT No.: PCT/US2004/041623

§ 371 (c)(1), (2), (4) Date: Sep. 17, 2007

(87) PCT Pub. No.: WO2005/060631

PCT Pub. Date: Jul. 7, 2005

(65) Prior Publication Data

US 2011/0146853 A1 Jun. 23, 2011

Related U.S. Application Data

(60) Provisional application No. 60/528,660, filed on Dec. 11, 2003.

(51) Int. Cl.
*C22F 1/18* (2006.01)
*C22C 14/00* (2006.01)

(52) U.S. Cl. ..... 148/564; 148/670; 148/421

(58) Field of Classification Search ..... 420/417; 148/669, 564, 670, 421

See application file for complete search history.

(56) References Cited

U.S. PATENT DOCUMENTS 5,131,959 A * 7/1992 Huang ..... 148/421

* cited by examiner

*Primary Examiner* — Jessee R. Roe

(74) *Attorney, Agent, or Firm* — Nixon & Vanderhye PC

(57) ABSTRACT

A method for refining the microstructure of titanium alloys in a single thermomechanical processing step, wherein the titanium alloy comprises boron. In some embodiments, the method comprises the steps of first adding boron to the titanium alloy then subjecting the boron-containing titanium alloy to a thermomechanical processing step. Also provided is a method for achieving superplasticity in titanium alloys comprising the steps of selecting a boron-containing titanium alloy, determining the temperature and strain rate necessary to achieve beta superplasticity, and applying sufficient temperature and strain rate to the boron-containing titanium alloy to deform the alloy to the desired shape. Also provided methods of forming titanium alloy parts and the parts prepared by these methods.

7 Claims, 15 Drawing Sheets

| Alloy | B | O | Al | V | Sn | Zr | Mo | Si | Fe | C | H | N | Others | Ti |
|---|---|---|---|---|---|---|---|---|---|---|---|---|---|---|
| CP Ti-0.02B | 0.02 | 0.10 | ... | ... | ... | ... | ... | ... | 0.03 | 0.03 | 0.003 | 0.01 | 0.3 | bal. |
| CP Ti-0.1B | 0.11 | 0.12 | ... | ... | ... | ... | ... | ... | 0.03 | 0.02 | 0.003 | 0.01 | 0.3 | bal. |
| CP Ti-0.4B | 0.41 | 0.11 | ... | ... | ... | ... | ... | ... | 0.03 | 0.02 | 0.003 | 0.01 | 0.3 | bal. |
| Ti-64 | | 0.21 | 5.90 | 3.85 | ... | ... | ... | ... | 0.21 | 0.02 | 0.006 | 0.02 | 0.2 | bal. |
| Ti-64-0.02B | 0.02 | 0.14 | 5.83 | 3.97 | ... | ... | ... | ... | 0.14 | 0.02 | 0.004 | 0.01 | 0.2 | bal. |
| Ti-64-0.05B | 0.045 | 0.19 | 6.02 | 3.83 | ... | ... | ... | ... | 0.14 | 0.02 | 0.006 | 0.01 | 0.2 | bal. |
| Ti-64-0.1B | 0.11 | 0.14 | 5.83 | 3.83 | ... | ... | ... | ... | 0.13 | 0.03 | 0.003 | 0.01 | 0.2 | bal. |
| Ti-64-0.4B | 0.47 | 0.16 | 5.92 | 3.90 | ... | ... | ... | ... | 0.13 | 0.02 | 0.004 | 0.01 | 0.2 | bal. |
| Ti-64-1B | 0.94 | 0.19 | 5.78 | 3.82 | ... | ... | ... | ... | 0.20 | 0.03 | 0.007 | 0.01 | 0.2 | bal. |
| Ti6242S-0.1B | 0.12 | 0.20 | 5.88 | ... | 1.94 | 4.16 | 1.93 | 0.12 | 0.04 | 0.01 | 0.004 | 0.008 | 0.2 | bal. |
| Ti6242S-0.5B | 0.59 | 0.22 | 5.86 | ... | 1.93 | 4.17 | 1.93 | 0.14 | 0.05 | 0.01 | 0.004 | 0.009 | 0.2 | bal. |
| Ti6242S-1B | 1.01 | 0.21 | 5.83 | ... | 1.93 | 4.10 | 1.96 | 0.13 | 0.05 | 0.01 | 0.006 | 0.01 | 0.2 | bal. |

Fig. 7

TITANIUM ALLOY MICROSTRUCTURAL REFINEMENT METHOD AND HIGH TEMPERATURE, HIGH STRAIN RATE SUPERPLASTIC FORMING OF TITANIUM ALLOYS

This application is the US national phase of international application PCT/US2004/041623 filed 13 Dec. 2004, which designated the U.S. and claims priority of U.S. Provisional Application No. 60/528,660, dated 11 Dec. 2003, the entire contents of each of which are hereby incorporated by reference.

CROSS-REFERENCE TO RELATED APPLICATIONS

This application claims priority to U.S. Provisional Patent Application No. 60/528,660, entitled "Titanium Alloy Microstructural Refinement Method and High Temperature-High Strain Rate Superplastic Forming of Titanium Alloys" filed Dec. 11, 2003, the entirety of which is incorporated herein by reference.

STATEMENT REGARDING FEDERALLY FUNDED RESEARCH

This invention was made, at least in part, by the US Air Force, under Contract No. F33615-03-D-5801. The government may have certain rights in this invention.

BACKGROUND OF THE INVENTION

For many applications, the grain size of titanium alloys must be reduced. However, the processes for reducing grain size in titanium alloys requires a number of iterative processing steps, which is disadvantageous, both in time and expense. The sequence of TMP steps conventionally used to manufacture semi-finished and finished products in these titanium alloys is shown in FIG. 1 along with the microstructures that are produced by these steps. This involves the three general processes of ingot breakdown, conversion, and finishing (FIG. 1(*a*)). The objective of ingot breakdown is to break down the coarse as-cast microstructure and obtain a lamellar structure with a refined prior beta grain size. Conversion processing involves conversion of ingots into mill products (e.g. billets, plates, and rods) with a concurrent breakdown of the lamellar microstructure (FIG. 1(*b*)) into equiaxed grains (FIG. 1(*c*)). This is achieved by extensive deformation (>75% reduction) using a process such as cogging, illustrated in FIG. 1(*d*). Since the amount of deformation that the billet can withstand without damage in a single cogging step is much less than this amount, many iterations of this mechanical working step are required in the $\alpha+\beta$ phase field. Finishing involves either $\alpha+\beta$ or $\beta$ processing with appropriate heat treatment to obtain the desired final microstructure. While the lamellar microstructure produced after ingot breakdown exhibits high strength and fracture toughness, equiaxed microstructures produced after conversion possess excellent ductility and resistance to crack initiation under low-cycle fatigue loading, each of which are necessary for fracture-critical structural components. Thus, the ingot breakdown and conversion steps in the TMT sequence used for the majority of titanium alloys are critical, and consume a significant amount of time (14-16 hours). A need exists therefore for an improved method for microstructural refinement that reduces or eliminates the number of iterative processing steps, thus reducing the cost and the lead-time in component manufacture while maintaining the necessary microstructural control. Such a process would provide improved microstructural refinement and make the manufacture of titanium components more affordable.

Superplasticity is the ability of the material to undergo large plastic deformation in tension (above 200% elongation) without failure and is typically exhibited by materials with fine grain size (<10 μm). Titanium alloys do not exhibit fine-grained superplasticity at high temperatures in the monolithic beta phase field due to rapid grain growth. A need exists for the ability to achieve superplasticity in titanium alloys at higher temperatures; thus enabling efficient forming of intricate near-net or net shapes with enhanced mechanical properties using smaller capacity presses. A need further exists for achieving superplasticity at higher strain rates compared with conventional superplasticity, which would considerably increases the production rates of wrought titanium alloy products.

SUMMARY OF THE INVENTION

Refining microstructure in titanium alloys Provided herein is a method of refining the microstructure in titanium alloys, the method comprising the step of subjecting a boron-containing titanium alloy to a thermo-mechanical processing (TMP) step; wherein a fine-grained microstructure in the titanium alloy is achieved after a single TMP step. The resulting titanium alloy, having a fine, equiaxed grain structure, may then be subjected to one or more further TMP steps to produce a desired shape. The TMP step may be a conventional TMP step. The inventive method differs from previous methods, however, in that only a single TMP step is required to achieve a fine-grained, equiaxed structure, whereas conventional methods require many iterations of the TMP steps to achieve a similar grain structure. Titanium alloys that may be used in the methods described herein include both conventional as well as novel titanium alloys.

In another embodiment, the method described herein comprises the steps of (a) adding boron to a titanium alloy to form a boron-containing titanium alloy and (b) subjecting the boron-containing titanium alloy to a thermo-mechanical processing (TMP) step; wherein a fine-grained microstructure in the titanium alloy is achieved after a single TMP step. After the TMP step, the titanium alloy has a fine-grain, equiaxed structure that could previously only be achieved through repetitive TMP steps. In one embodiment, the boron maybe added to the titanium alloy in the liquid state, wherein the boron is completely dissolved in the liquid titanium alloy. In a second embodiment, the boron may be added to the titanium alloy through intermixing of solid powders, as by powder metallurgy. Regardless of the process used to add the boron to the titanium alloy, the boron may be added as elemental boron, $TiB_2$, or as any appropriate master alloy containing boron. The boron may be added in amounts in the range from 0.01% to 18.4%, by weight. In some embodiments, the boron is added to the titanium alloy in amounts ranging from 0.5% to 1.6%, by weight.

Further provided is a method of achieving beta-phase superplasticity comprising the step of deforming the alloy under beta-phase strain rates and temperature conditions that correlate with the specific titanium alloy and boron content. The deformation conditions, i.e., the temperatures and strain rates may readily be determined by those skilled in the art, as by preparing microstructural mechanism maps for the particular boron-containing titanium alloy. Provided also are methods of forming titanium alloy parts, the method comprising selecting a boron-containing titanium alloy, determining the temperature and strain rate necessary to achieve beta superplasticity, and applying sufficient temperature and strain rate to the boron-containing titanium alloy to deform the alloy to the desired shape. Also provided are the parts prepared by these methods.

Provided herein are methods of forming TiB precipitates in the titanium alloy. In one method, the boron is added to the alloy in the liquid state, wherein the boron is completely dissolved in the liquid titanium alloy. The boron liquid may be selected from the group consisting of elemental boron, $TiB_2$, a boron containing alloy, and combinations thereof. The liquid may then be cast into product form, cast into a billet, or converted to a powder. The boron-containing titanium powder may be consolidated via conventional compaction techniques, such as unidirectional compaction, vacuum hot pressing, hot isotactic pressing, and so forth, or by other novel compaction techniques.

In a second method, the boron-containing titanium alloy may be formed by intermixing solid boron particles with solid titanium alloy particles, the method comprising blending the solid boron particles with the solid titanium particles until the particles are a uniformly distributed boron-titanium alloy mixture; outgassing the uniformly distributed boron-titanium alloy mixture; heating the uniformly distributed boron-titanium alloy mixture to react the boron with the titanium; and consolidating the reacted powder. The boron powder may be selected from the group consisting of elemental boron, $TiB_2$, a boron containing alloy, and combinations thereof. The resulting boron-containing titanium alloys are capable of deforming superplatically in the beta phase, through application of appropriate temperature and strain rates.

The amount of boron in the titanium alloy may be in the range from 0.01 to 18.4%, by weight. In some embodiments, the boron is present in the alloy in levels from 1.6 to 2.9%, by weight. The method of achieving superplasticity in the beta-phase of titanium alloys described herein may be carried out without a boron-addition step by starting with a boron-containing titanium alloy.

Also provided are titanium parts made by the methods described herein.

BRIEF DESCRIPTION OF THE DRAWINGS

FIG. 7 Table showing several cast Ti—B alloy compositions prepared.

DETAILED DESCRIPTION OF THE INVENTION

Affordable Titanium Alloy Microstructural Refinement Method Microstructural refinement in titanium alloys is an essential step in the shape-forming of titanium alloy components for obtaining a balance of strength, ductility and damage tolerance. Conventionally, this is achieved by extensive mechanical working at high temperatures for several hours to break down the coarse as-cast microstructure as well as to convert the lamellar microstructure into an equiaxed morphology during billet conversion. Provided herein is a novel method for titanium alloy microstructural refinement by the addition of boron in combination with minimal thermo-mechanical processing. Boron addition causes formation of fine in situ titanium boride (TiB) precipitates that not only restrict the grain growth at high temperatures but also assist in the nucleation and growth of fine equiaxed grains during thermo-mechanical processing. The methods described herein achieve microstructural refinement by exploiting the influence of TiB precipitates on the alloy microstructure evolution in combination with minimal thermomechanical deformation processing, thus enabling reduction or elimination of several lengthy processing steps typically required during conventional ingot breakdown and billet conversion operations. This innovation significantly reduces the lead-time and improves the affordability of wrought titanium alloy products.

Titanium alloys offer a unique combination of mechanical and physical properties, which make them desirable for a variety of critical applications. As-cast microstructures in titanium alloys are extremely coarse and these must be refined to meet the property (strength, ductility, damage tolerance, etc.) requirements for structural applications. The desired balance of properties is obtained by controlling the microstructure, which is conventionally achieved by extensive thermomechanical processing (TMP) sequences involving billet heating and mechanical deformation, which is repeated many times over a period of several hours. The purpose the methods described herein is to describe a novel improvement to the prior art for achieving microstructural refinement without subjecting billets to lengthy and expensive repetitive TMP. The method described in this disclosure involves adding a small amount of boron to the Ti alloy, which causes the formation of fine TiB intermetallic compound precipitates, and making use of their influence on the alloy microstructure evolution during subsequent thermo-mechanical processing. The TiB precipitates restrict grain growth at high temperatures as well as help in modifying the titanium phase transformation kinetics to produce fine-grained microstructures with a single TMP step. The new method has been successfully verified for reproducibility and consistency. Scaled-up extrusion and forging experiments have been conducted to demonstrate the validity of the new process in larger components under complex manufacturing conditions.

Figure 1:
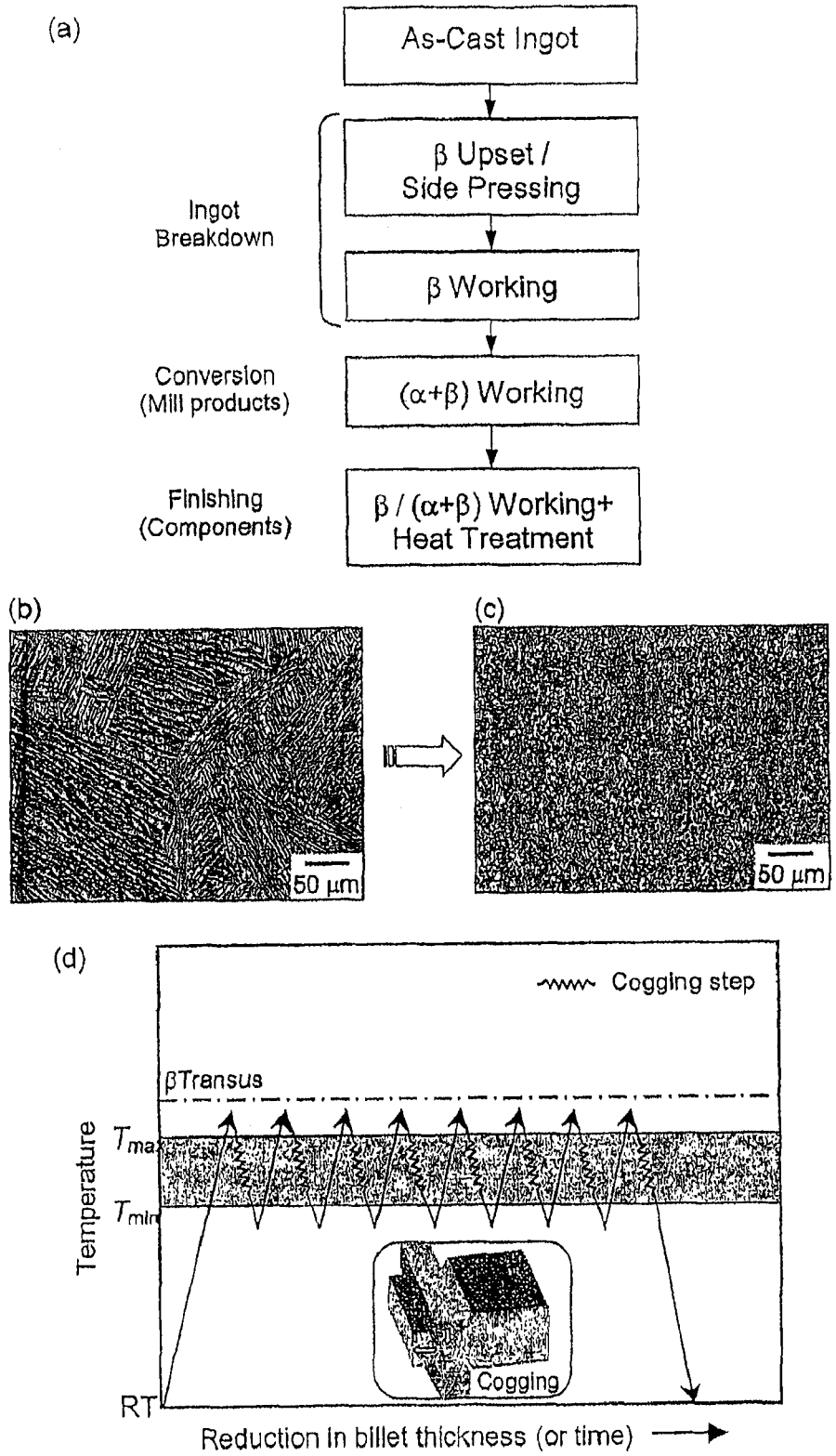
FIG. 1 (a) Typical thermochemical processing sequence used for titanium alloys, (b) lamellar microstructure that develops after ingot breakdown, (c) equiaxed microstructure produced after conversion, (d) typical cogging sequence used for titanium alloy conversion.

The methods described herein are microstructural refinement methods that aer relevant for conventional titanium alloys and are expected to also work for newly developed alloys. All alloy compositions are provided in weight percent. The prior art sequence of TMP steps conventionally used to manufacture semi-finished and finished products in these titanium alloys is shown in FIG. 1 along with the microstructures that are produced by these steps. This involves the three general processes of ingot breakdown, conversion, and finishing (FIG. 1(*a*)). The objective of ingot breakdown is to break down the coarse as-cast microstructure and obtain a lamellar structure with a refined prior beta grain size. Conversion processing involves conversion of ingots into mill products (e.g. billets, plates, and rods) with a concurrent breakdown of the lamellar microstructure (FIG. 1(*b*)) into equiaxed grains (FIG. 1(*c*)). This is achieved by extensive deformation (>75% reduction) using a process such as cogging, illustrated in FIG. 1(*d*). Since the amount of deformation that the billet can withstand without damage in a single cogging step is much less than this amount, many iterations of this mechanical working step are required in the $\alpha+\beta$ phase field. Finishing involves either $\alpha+\beta$ or $\beta$ processing with appropriate heat treatment to obtain the desired final microstructure. While the lamellar microstructure produced after ingot breakdown exhibits high strength and fracture toughness, equiaxed microstructures produced after conversion possess excellent ductility and resistance to crack initiation under low-cycle fatigue loading, each of which are necessary for fracture-critical structural components. Thus, the ingot breakdown and conversion steps in the TMP sequence used for the majority of titanium alloys are critical, and consume a significant amount of time (14-16 hours). A need exists therefore for an improved method for microstructural refinement that reduces or eliminates the number of iterative processing steps, thus reducing the cost and the lead-time in component manufacture while maintaining the necessary microstructural control. Such a process would provide improved microstructural refinement and make the manufacture of titanium components more affordable.

Here, we demonstrate a novel method of obtaining refined microstructural features in titanium alloys by a single thermo-mechanical processing (TMP) step after boron modification. This alloy modification causes the natural evolution of refined microstructural features that are similar to those obtained only by extensive deformation processing steps using prior art methods in conventional titanium alloys.

Figure 2:
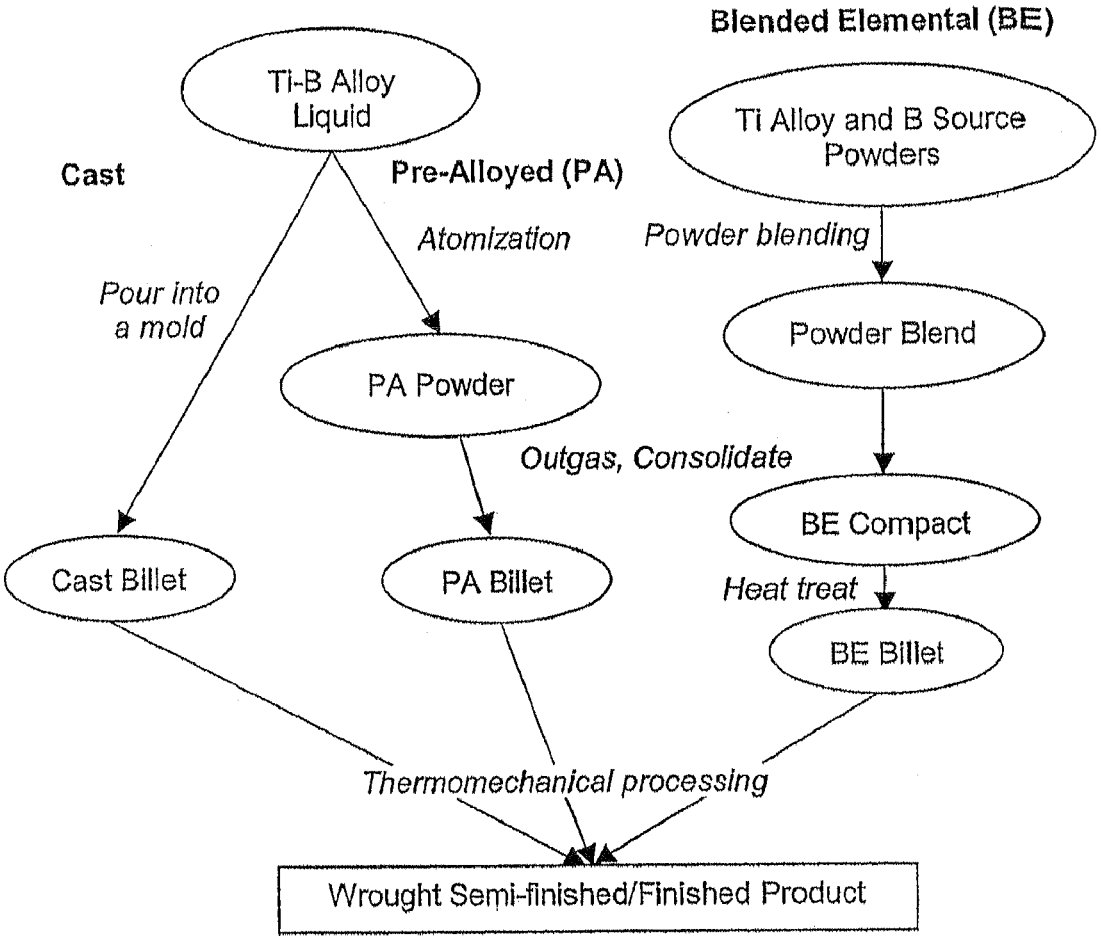
FIG. 2 Flow chart showing typical routes to produce Ti—B alloy products.

As described herein, boron is added to any titanium alloy to refine the microstructure and to retain a refined microstructure during subsequent TMP. Some routes used for producing Ti—B alloy products are shown in the flow diagram in FIG. 2. The boron may be added to the titanium alloy either in the liquid state, or by the intermixing of solid particles via powder metallurgy or related technologies. When added in the liquid state, the boron is completely dissolved in the liquid titanium alloy, and the TiB intermetallic phase precipitates from the solid titanium alloy upon cooling. From the liquid state, the boron-modified alloy may be subsequently cast into a billet or into a product form, or may be converted to powder via any conventional or novel powder conversion technology. Boron-containing titanium alloy powder produced in this way may be consolidated and/or formed via conventional or modified techniques. When the boron is added by the intermixing of solid particles, an appropriate blending process is required to ensure a uniform distribution of the boron. The blended powder is then subjected to appropriate outgassing (to remove impurities), heat treatment (to allow the formation of the stable TiB particles) and consolidation processes. In each of the processes above, the consolidated boron-containing titanium alloy billet may be subjected to further TMP to produce the desired shape. However, the amount of TMP required to produce a desirable microstructure will be dramatically reduced relative to conventional methods.

In either liquid state processes or powder metallurgy techniques, the boron may be added as elemental boron, as $TiB_2$, or as any appropriate master alloy containing boron. The grain refinement effect described herein has been verified for boron levels from 0.5-1.6% in the most in the alloy Ti-6Al-4V. In accordance with the methods described herein, the amount of boron added may be as low as 0.01% and as high as 18.4% depending upon such factors as the composition of the alloy.

In some embodiments, the amount of boron added to the titanium alloy will be as little as a trace amount. In most embodiments, the amount of boron added will be in the range from 0.01% to 18.4%. In some embodiments, the amount of boron added will be in the range from 0.01% to 0.05%. In other embodiments, the amount of boron added will be in the range from 0.01% to 0.1%. In other embodiments, the amount of boron added will be in the range from 0.1% to 0.5%. In other embodiments, the amount of boron added will be in the range from 0.5% to 1.6%. In still other embodiments, the amount of boron added is in the range from 1.6% to 2.9%. Moreover, the amount of boron added to the titanium alloy may be within the range from 0.01% to 18.4%, including 0.01%, 0.02%, 0.03%, 0.04%, 0.05%, 0.06%, 0.07%, 0.08%, 0.09%, 0.1%, 0.2%, 0.3%, 0.4%, 0.5%, 0.6%, 0.7%, 0.8%, 0.9%, 1.0%, 1.1%, 1.2%, 1.3%, 1.4%, 1.5%, 1.6%, 1.7%, 1.8%, 1.9%, 2%, 3%, 4%, 5%, 6%, 7%, 8%, 9%, 10%, 11%, 12%, 13%, 14%, 15%, 16%, 17%, 18%, up to 18.4%. Using the methods described herein, the appropriate amount of boron for a specific alloy can readily be determined by those skilled in the art.

Figure 3:
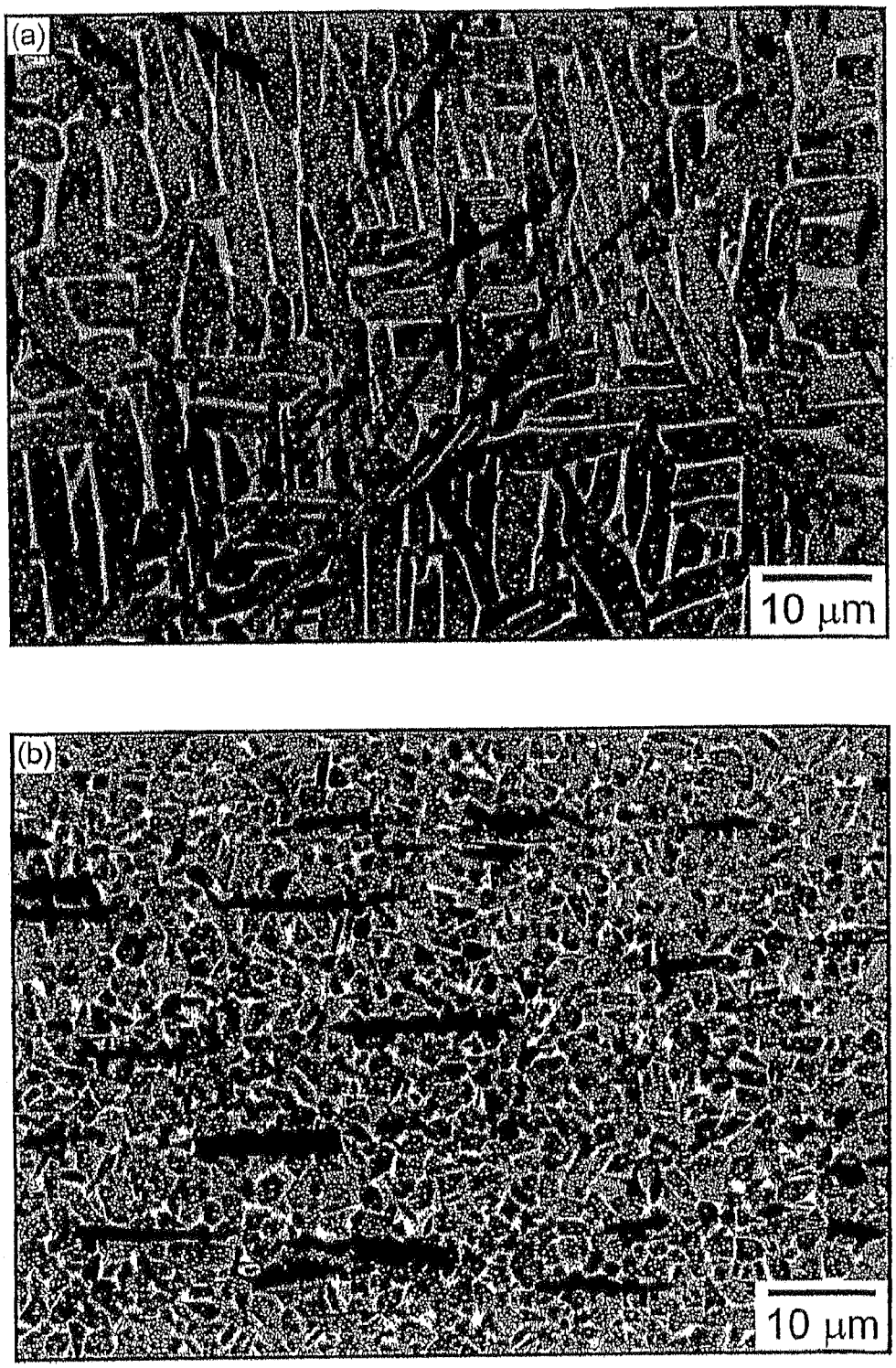
FIG. 3 Backscatter SEM micrographs of Ti-6Al-4V-0.5B: (a) as-cast+HIP and (b) after extrusion at 1100° C.

For example, in some embodiments of the alloy Ti-xB, x is in the range from 0.02% to 0.4%; in one embodiment, x is 0.02%; in another embodiment, x is 0.1%, and in yet another embodiment, x is 0.4%. In some embodimetns of Ti-64-xB, x is in the range from 0.02% to 1.0%; wherein specific embodiments are x is 0.02%, 0.05%, 0.1%, 0.4%, 1%. In another embodiment, These embodiments are illustrative of Cast Approach As an example of the present methods, cast Ti-6Al-4V-0.5B produced by triple consumable arc melting and isostatically pressed at 900° C. for 1 hour was supplied by PCC Structurals, Inc., Portland, Oreg. The boron was added to the alloy melt in the form of $TiB_2$ that completely dissolves in the liquid melt and forms TiB in situ during solidification. The cast billet dimensions were 75 mm diameter and 125 mm in height. The resulting microstructure is shown in FIG. 3(*a*), which shows TiB precipitates uniformly dispersed in a completely lamellar titanium alloy microstructure. This billet was heated to 1100° C., soaked for 1 hour, extruded using a conical die of extrusion ratio 16.5:1 at a ram speed of 6.35 mm $s^{-1}$ in a chamber heated to 260° C., and the extruded rod was air cooled to room temperature. The microstructure after extrusion is shown in FIG. 3(*b*) which shows a completely equiaxed morphology with a grain size of 2 μm. The equiaxed microstructure is obtained in just about an hour of processing time after casting in the present method, which otherwise requires several hours using prior art methods to produce similar microstructure.

Pre-Alloyed Powder Approach

Figure 4:
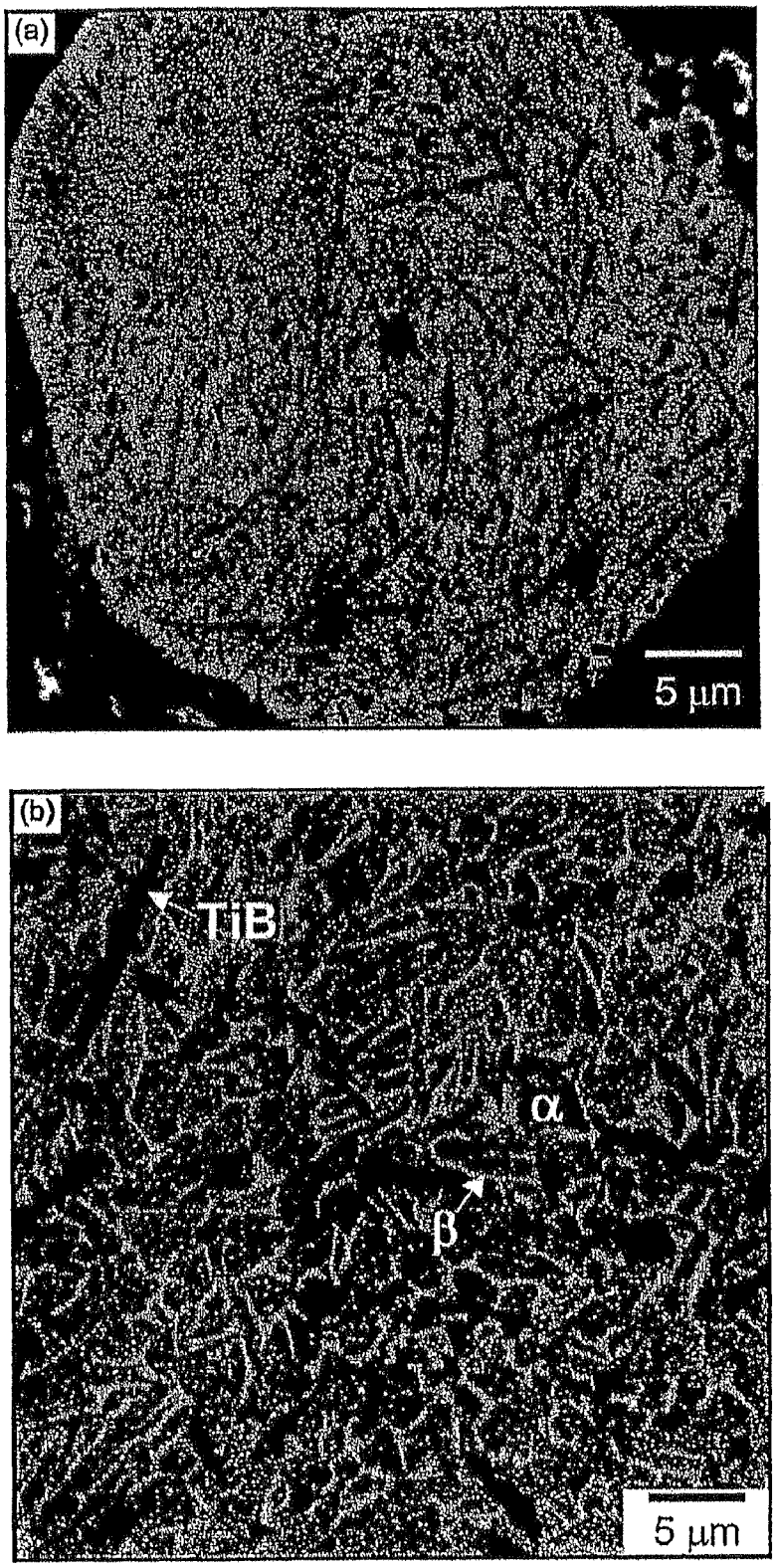
FIG. 4 Backscatter SEM micrographs of Ti-6Al-4V-1.6B: (a) as-received powder particle cross-section and (b) after powder compaction at 1200° C.

Pre-alloyed powder of Ti-6Al-4V-1.6B prepared by inert gas (argon) atomization was procured from Crucible Research Corporation, Pittsburgh, Pa. Boron additions to the melt were made in the form of $TiB_2$ that completely dissolves in the liquid melt and forms TiB in situ during powder production. The melting procedure involved induction skull (made of a titanium alloy) melting of appropriate amounts of the raw materials (Ti, Al—V master alloy, and $TiB_2$) in a water-cooled copper crucible. The Ti-6Al-4V-1.613 powder was screened to obtain a −100 mesh size fraction (150 μm mesh opening size). A representative microstructure of the cross-section of a powder particle is shown in FIG. 4(*a*), which reveals the presence of fine TiB precipitates in the form of short whiskers.

About 1 kg of as-received powder was packed inside a thick-walled (6.35 mm) Ti-6Al-4V can that was 70 mm in diameter and 130 mm long. The powder was vacuum outgassed at 300° C. for 24 h and sealed. The can was coated with glass for lubrication and minimizing the oxidation damage, heated to 1200° C., soaked for 1 h, and then subjected to blind-die compaction (BC) in an extrusion chamber heated to 260° C. The billet height was reduced by about 30% at a ram speed of 6.35 mm $s^{-1}$, the compact was held at a pressure of 1400 MPa for 180 s, and subsequently air-cooled to room temperature. The microstructure after powder compaction is shown in FIG. 4(*b*), which shows an equiaxed grain structure. To obtain this refined microstructure in the prior art method, extensive processing in the two phase field after compaction is necessary, whereas in the new method the compaction step itself is sufficient for achieving full density as well as microstructural refinement.

Figure 5:
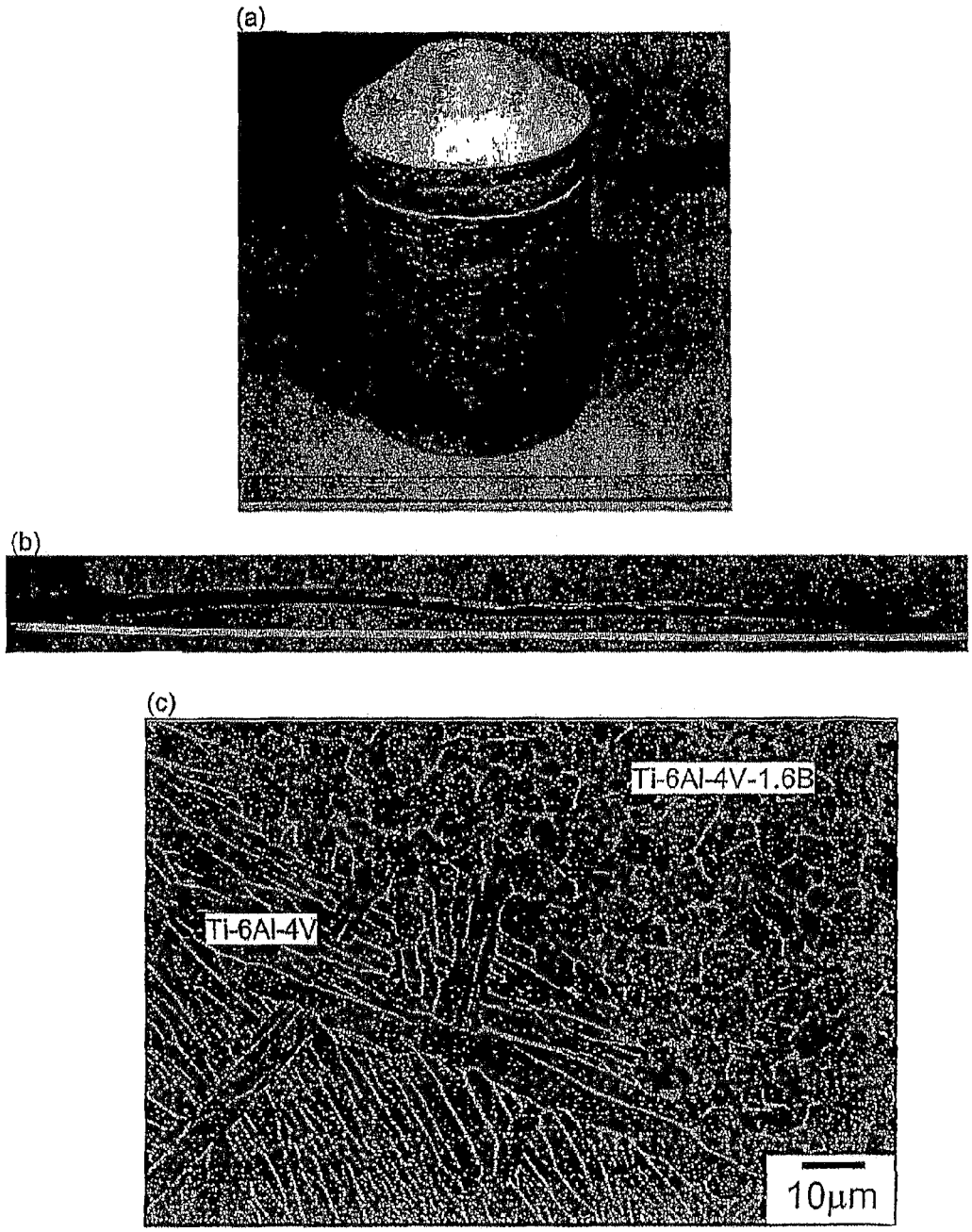
FIG. 5 (a) Photograph of compacted Ti-6Al-4V-1.6B, (b) photograph of extruded rod, and (c) backscatter SEM micrograph in the transverse direction of the extrusion.

A compacted billet was subjected to extrusion using the following process schedule: heat to 1100° C., soak for 1 h, round-to-round extrusion using 16.5:1 conical die, 6.35 mm $s^{-1}$ ram speed, and air-cool to room temperature. The billet before extrusion, the extruded rod, and the microstructure after extrusion are shown in FIG. 5. The extruded Ti-6Al-4V-1.6B microstructure in FIG. 5(*c*) shows a completely equiaxed microstructure, while the microstructure of the Ti-6A1-4V can material subjected to the same processing conditions shows a very coarse lamellar microstructure with a prior beta grain size of 2-3 mm. FIG. 5(*c*) clearly demonstrates the effectiveness of a small addition of boron in producing and stabilizing a fine, equiaxed grain structure with a minimal amount of TMP.

The mechanism by which microstructural refinement is achieved in the method described herein is much different conventionally used. First, the absence of grain growth after processing at very high temperatures, including temperatures above the beta transus, clearly shows that the borides effectively pin the grain boundaries. In the absence of borides, rapid grain coarsening occurs above the beta transus. Second, the presence of an equiaxed grain morphology rather than a lamellar microstructure typically observed using other methods, even after cooling from temperatures above the β transus, is a clear indication of the influence of borides on the phase transformation kinetics in titanium alloys. It is believed that fine second phase precipitates (titanium borides in the present case) not only act as heterogeneous nucleation sites, but also generate large amount of dislocations in the matrix, which further stimulate heterogeneous nucleation of the a phase and lead to the formation of equiaxed grains.

The successful implementation of the new microstructural refinement process described herein depends on the proper understanding of the influence of boron on the microstructural evolution in titanium alloys. The specific conditions of temperature and strain rate that will produce the microstructural refinement claimed here will vary for each alloy composition, starting microstructure, and specific metalworking process employed. The strain rate and temperature parameters may readily be optimized by one of ordinary skill in the art for each specific composition and the starting microstructure to achieve refined microstructures in titanium alloys. Additions of boron as low as 0.01% to titanium alloys causes formation of TiB precipitates which enable microstructural refinement during thermo-mechanical processing. The amount of boron to be added to obtain refined microstructures in titanium alloys depends on the composition of the alloy and the thermo-mechanical processing parameters, which may readily be optimized by one of ordinary skill in the art.

Validation Experiment

Figure 6:
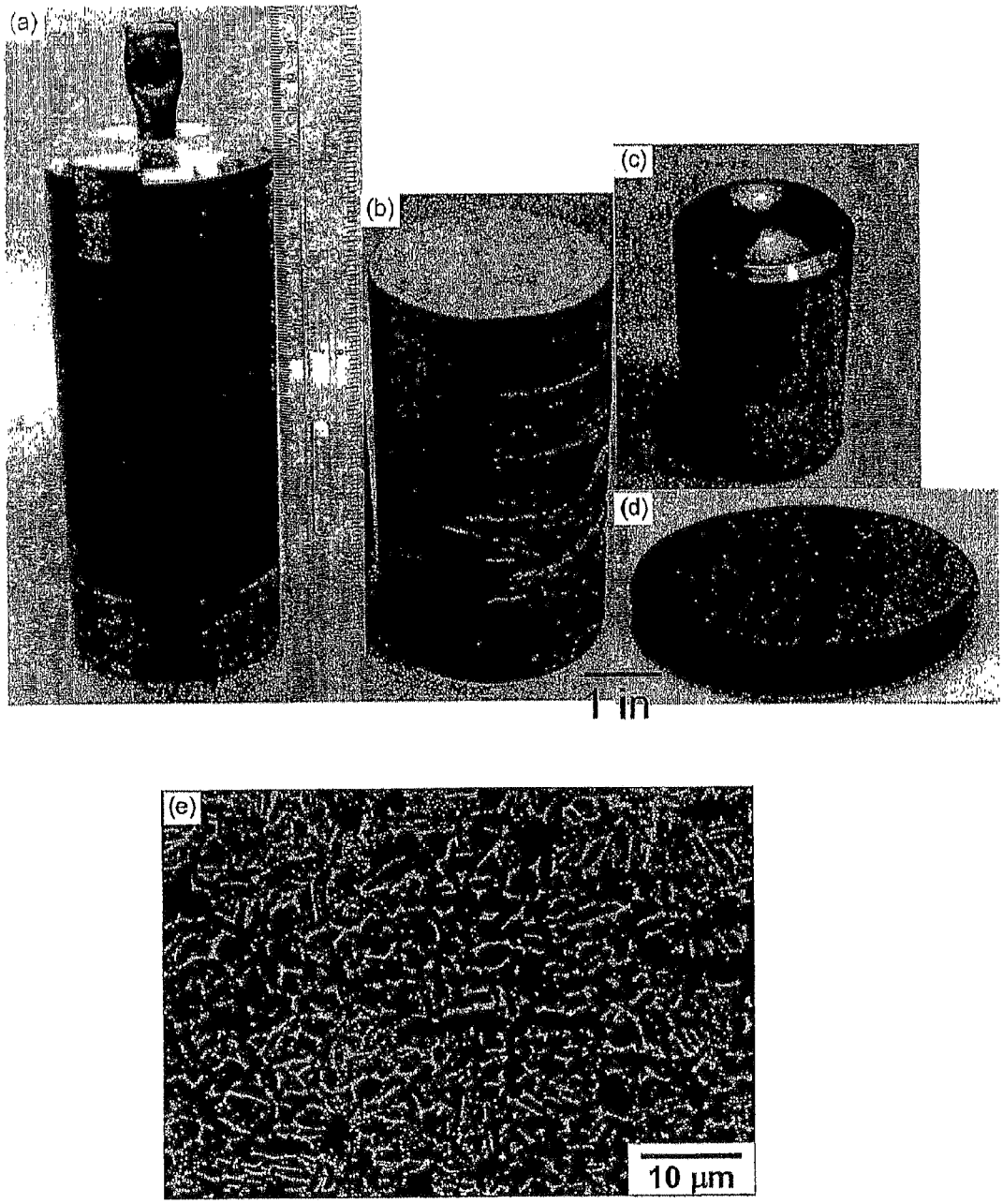
FIG. 6 Forging validation experiment (a) can filled with Ti-6Al-4V-1.6B powder and sealed in vacuum after outgassing, (b) consolidated billet (c) after machining of can material, (d) after forging, and (e) backscatter SEM image of microstructure of the forging cross-section.
Figure 8:
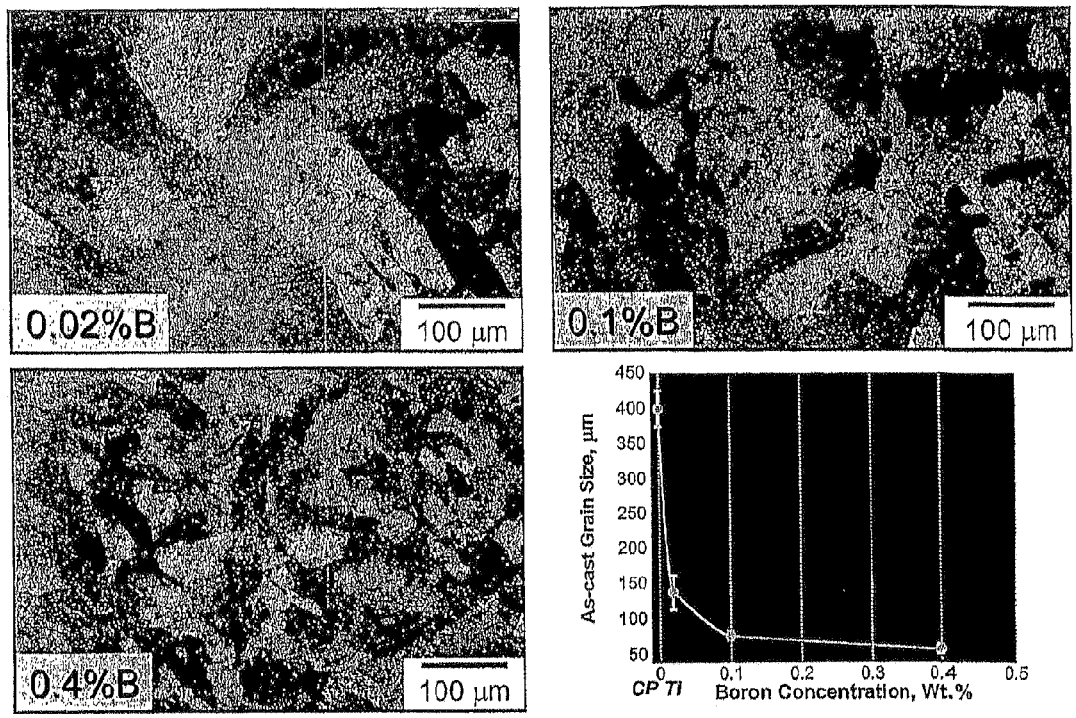
FIG. 8 Micrographs of CP Ti-xB Microstructures showing 0.02% B, 0.1% B, and 0.4% B.
Figure 9:
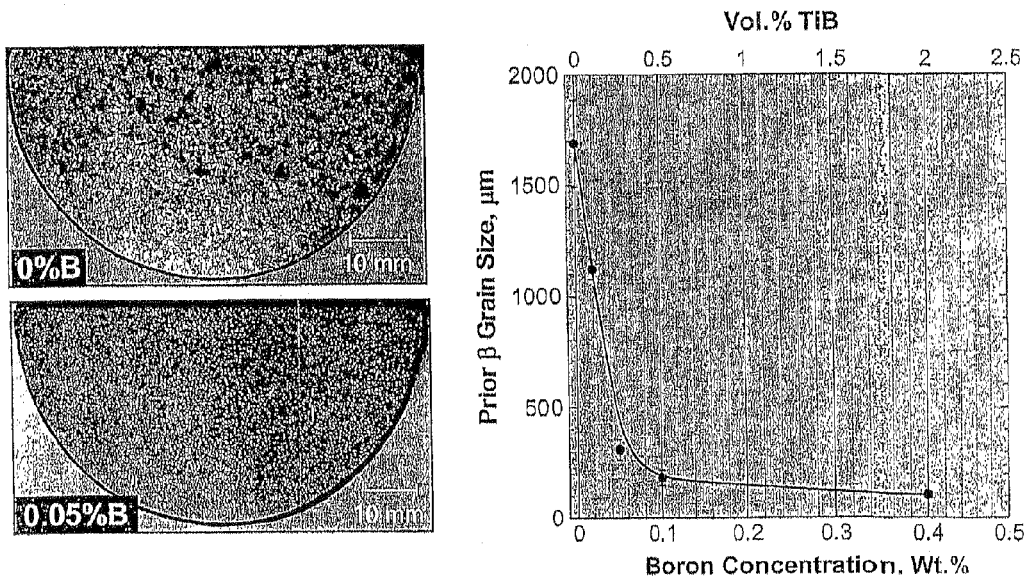
FIG. 9 Micrographs showing grain refinement in Ti-64 via B addition and a graph showing β grain size in microns versus boron concentration in weight percent.

To validate the new microstructural refinement process, a forging experiment was performed using a hydraulic press of 10,000 kN capacity. Ti-6Al-4V-1.6B pre-alloyed powder was filled in a Ti-6Al-4V can of 70 mm diameter and 130 mm long, outgassed and sealed in vacuum. The powder was consolidated by unidirectional compaction at 1200° C. and the billet height was reduced by about 30%. After compaction, the can material was machined off and this billet was used for forging experiment. The billet was heated to 1100° C., soaked for 1 hour, and forged at a ram speed of 8.5 mm $s^{-1}$ to obtain a disk of 19 mm thick and 133 mm diameter. Photographs of the billet and forged disk are shown in FIG. 6 along with the microstructure of the forging. A very fine grained equiaxed microstructure without any defects has been recorded. This experiment demonstrates the new microstructural refinement method by thermo-mechanical processing of boron modified titanium alloy could be implemented to produce larger size components under complex conditions that exist in a manufacturing environment.

The new method reduces or eliminates several lengthy and expensive ingot breakdown and conversion processing steps, thus significantly reducing the processing cost and lead-time of titanium alloy component manufacture.

The method described herein has the ability to obtain refined microstructures in a single thermomechanical processing step makes it possible to produce near-net shapes using small size cast ingots, which minimizes material wastage and provides additional cost savings.

Boron can be simply added to the titanium alloy melt as another alloying element and therefore does not increase the material cost. In addition, conventional thermo-mechanical processing techniques can be used to obtain the microstructural refinement.

Ability to process at high temperatures reduces the flow stresses significantly which can be advantageously used to perform hot working operations using smaller capacity presses and low cost dies.

High Temperature-High Strain Rate Superplastic Forming of Titanium Alloys

Superplasticity is the ability of the material to undergo large plastic deformation in tension (above 200% elongation) without failure and is typically exhibited by materials with fine grain size (<10 μm). Titanium alloys generally do not exhibit fine-grained superplasticity at high temperatures in the monolithic beta phase field due to rapid grain growth. Using the method described herein, superplasticity can be achieved in the beta phase field of titanium alloys by restricting grain growth in the monolithic beta phase field. The approach described herein takes advantage of the influence of boron additions on the alloy microstructure during thermo-mechanical processing. The titanium boride (TiB) precipitates that form due to the addition of boron restrict the beta grain growth and stabilize a fine, equiaxed beta grain size at the deformation temperature, thereby enabling superplasticity. The ability to achieve superplasticity at higher temperatures enables efficient forming of intricate near-net or net shapes with enhanced mechanical properties using smaller capacity presses. The beta superplasticity also occurs at strain rates 2-3 orders of magnitude higher compared to the conventional superplasticity, which considerably increases the production rates of wrought titanium alloy products.

Many commercial processes make use of superplastic forming to manufacture titanium structural parts for a wide range of applications. Superplastic forming provides the ability to form intricate shapes to close dimensional tolerances using modest press capacities. It is well known that many titanium alloys exhibit superplasticity. However, the temperatures at which these alloys exhibit superplasticity are relatively low and the forming rates are therefore low, which limit the application of superplastic forming to small-lot high-performance applications. Above the temperature at which the titanium alloy transforms to monolithic beta phase, called the beta transus, extremely rapid grain growth occurs due to anomalously high atomic diffusion rates, making them unsuitable for superplastic flow [1]. The purpose the method of enabling superplasticity described herein is to retain a fine grain structure at temperatures above the beta transus of titanium alloys via the addition of boron and forming under a tailored combination of processing conditions to enable superplastic deformation with the added advantages of higher forming rates, lower flow stresses, better chemical homogeneity, and better microstructural control without any defects.

Superplasticity is the ability of the material to undergo large plastic deformation in tension (above 200% elongation) without failure. This behavior is shown by materials with a fine grain size, usually less than 10 μm, when they are deformed at slow strain rates ($<10\ s^{-1}$) at temperatures above $0.5T_m$, where $T_m$ is the melting point in Kelvin. Superplastic deformation, characterized by low flow stresses and high uniformity of plastic flow, has led to considerable commercial interest to form components using techniques similar to those developed for the forming of plastics. Superplastically formed parts find many uses particularly in aerospace. For example, the redesign of the F-15E fighter aircraft aft end used superplastically formed and diffusion bonded structure in place of the conventional sheet formed and riveted design, eliminating 726 part details and 10,000 fasteners, thereby improving the affordability and maintainability of the aircraft [2]. Superplastic forming is successfully used to manufacture intricate shapes such as hollow fan and compressor blades for aeroengines, and spherical fuel tanks in space vehicles [2]. Table 1 gives the superplasticity characteristics for a few conventional Ti alloys [1]. It may be seen that the superplasticity in conventional Ti alloys is found only at temperatures below the beta transus temperature. Rapid grain growth occurs above the beta transus temperature, which defeats the important prerequisite for superplasticity, viz. the fine grain size. Conventional superplasticity in titanium alloys is also restricted to low strain rate ranges mentioned in Table 1. High strain-rate superplasticity ($>10^{-2}\ s^{-1}$) is of great technological importance for the shape-forming of engineering materials due to significant increase in the production rates with improved properties. The ability to introduce and maintain a refined microstructure in the monolithic beta phase field, and hence achieve superplasticity at high temperature and high strain rate conditions in the beta phase field of titanium alloys is achieved using the methods described herein.

Using the methods described herein, titanium alloys can be made to flow superplastically in the beta phase field by adding boron and taking advantage of its effect on the alloy microstructural stability and thermo-mechanical response. Using these methods, superplasticity can be achieved at strain rates 2-3 orders of magnitude higher than those observed in known methods. Here we describe how superplasticity can be enabled in the beta phase field based on our specific observations on the most important titanium alloy Ti-6Al-4V (all compositions are given in weight percent) modified with 1.6-2.9% boron and deformed under specific temperature-strain rate conditions. The methods described herein are applicable to a wide range of titanium alloys for boron addition as low as 0.01% and as high as 18.4% depending upon the composition and thermo-mechanical response of the alloy.

In some embodiments, the amount of boron added to the titanium alloy will be as little as a trace amount. In most embodiments, the amount of boron added will be in the range from 0.01% to 18.4%. In some embodiments, the amount of boron added will be in the range from 0.01% to 0.05%. In other embodiments, the amount of boron added will be in the range from 0.01% to 0.1%. In other embodiments, the amount of boron added will be in the range from 0.1% to 0.5%. In other embodiments, the amount of boron added will be in the range from 0.5% to 1.6%. In still other embodiments, the amount of boron added is in the range from 1.6% to 2.9%. Moreover, the amount of boron added to the titanium alloy may be within the range from 0.01% to 18.4%, including 0.01%, 0.02%, 0.03%, 0.04%, 0.05%, 0.06%, 0.07%, 0.08%, 0.09%, 0.1%, 0.2%, 0.3%, 0.4%, 0.5%, 0.6%, 0.7%, 0.8%, 0.9%, 1.0%, 1.1%, 1.2%, 1.3%, 1.4%, 1.5%, 1.6%, 1.7%, 1.8%, 1.9%, 2%, 3%, 4%, 5%, 6%, 7%, 8%, 9%, 10%, 11%, 12%, 13%, 14%, 15%, 16%, 17%, 18%, up to 18.4%.

The boron may be added to the titanium alloy either in the liquid state, or by the intermixing of solid particles via powder metallurgy or related technologies. When added in the liquid state, the boron is completely dissolved in the liquid titanium alloy, and the TiB intermetallic phase precipitates from the solid titanium alloy upon cooling. From the liquid state, the boron-modified alloy may be subsequently cast into a billet or into a product form, or may be converted to powder via any conventional or novel powder conversion technology. Boron-containing titanium alloy powder produced in this way may be consolidated via conventional compaction techniques (e.g. unidirectional compaction, vacuum hot pressing, hot isostatic pressing, etc.). When the boron is added by the intermixing of solid particles, an appropriate blending process is required to ensure a uniform distribution of the boron. The blended powder is then subjected to appropriate outgassing (to remove impurities), heat treatment (to allow reaction of the boron with the titanium alloy to produce the stable TiB particles) and consolidation processes. In either liquid state processes or powder metallurgy techniques, the boron may be added as elemental boron, as $TiB_2$, or as any appropriate master alloy containing boron. The titanium alloy billet produced by any of the techniques described above can be subjected to thermomechanical processing under superplastic conditions identified in this to produce desired shapes.

Two regular grade Ti-6Al-4V alloys, one having 1.6B produced by prealloyed powder approach and the other having 2.9B produced by the blended elemental approach were used to demonstrate the methods described herein. In the former case, the material was produced by adding $TiB_2$ powder to the alloy melt followed by conversion to powder via inert gas (argon) atomization. In the latter case, powders of Ti-6Al-4V, $TiB_2$ and commercial purity Ti were blended in the required proportions. Both the prealloyed powder and the blended powder mixtures were consolidated by filling a thick-walled (6.35 mm) can that was 70 mm in diameter and 130 mm long made of conventional Ti-6Al-4V, vacuum outgassing at 300° C. for 24 h, and hermetic sealing. The can was heated to 1200° C., soaked for 1 h, and then blind-the compacted in an extrusion chamber heated to 260° C. The compact was held at a pressure of 1400 MPa for 180 and subsequently air-cooled to room temperature. A height reduction of 30% occurred after compaction. In the case of the blended powder, the compacted billet was then subjected to an annealing treatment at 1300° C. for 6 h to ensure the completion of the in situ chemical reaction (1).

$$Ti+TiB_2 \rightarrow 2TiB \quad (1)$$

Figure 10:
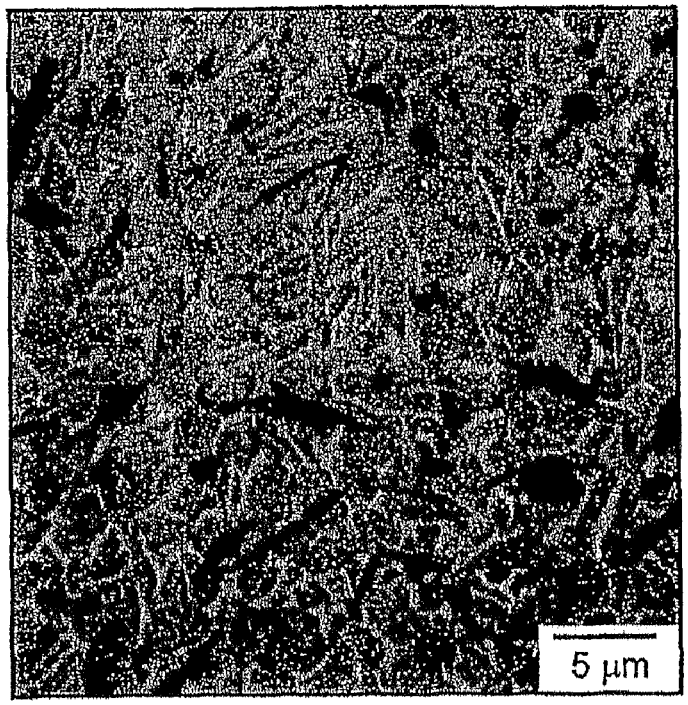
FIG. 10 SEM BEI micrographs of (a) Ti-6AI-4V-1.6B produced by the prealloyed powder route and (b) Ti-6AI-4V-2.9B produced by the blended elemental route. Both images show the fine equiaxed grain size and the TiB precipitates in the as-compacted material.
Figure 10:
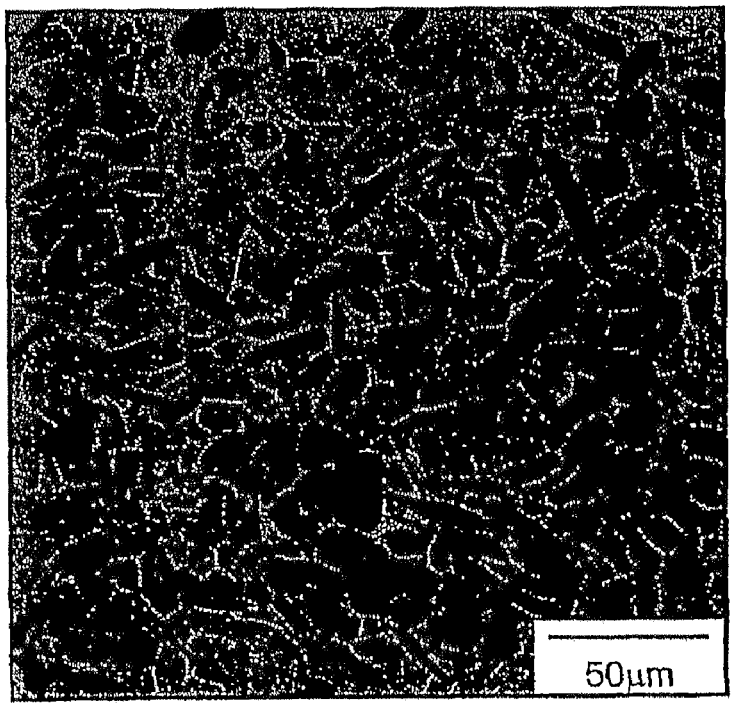
Figure 11:
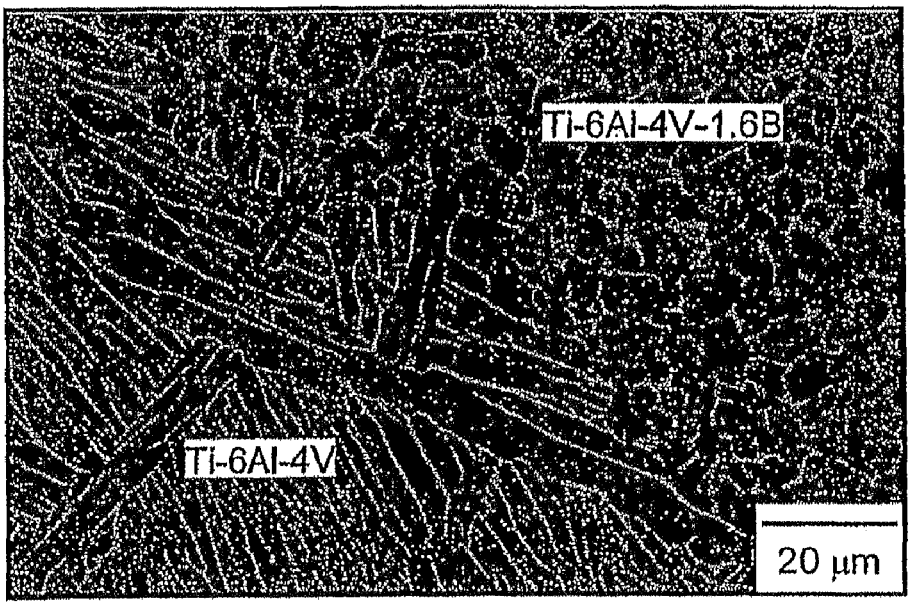
FIG. 11 SEM BEI micrograph of the as extruded Ti-6AI-4V-1.6B and the adjacent Ti6Al-4V can showing the potent ability of the boron addition to resist grain growth during processing above the beta transus.

This is not necessary in the case of the prealloyed powder compact as the boron is already present in the form of TiB precipitates in the as received powder. FIG. 7 shows scanning electron micrographs (SEM) in the backscattered electron imaging (BEI) mode of the as-compacted materials. FIG. 10(*a*) shows the microstructure of the Ti-6Al-4V-1.6B produced by the prealloyed powder method and FIG. 10(*b*) presents that of the Ti-6Al-4V-2.9B produced by the blended elemental approach. In both cases, fine equiaxed α+β microstructure and TiB precipitates in the form of needles can be observed. The effect of TiB in restricting grain growth is apparent from the micrograph presented in FIG. 11, wherein a transverse section of a Ti-6AI-4V-1.6B compact extruded above the beta transus of Ti-6Al-4V (1000° C.) at 1100° C. is shown. This figure also shows the microstructure of the can material (Ti-6Al-4V) that has been subjected to identical processing conditions as that of boron containing alloy. In the can material, the grains have grown to very large size (~1 mm) and a completely lamellar microstructure has formed while in the boron-containing alloy the microstructure consisted of equiaxed a grains of about 3 μm size.

Figure 12:
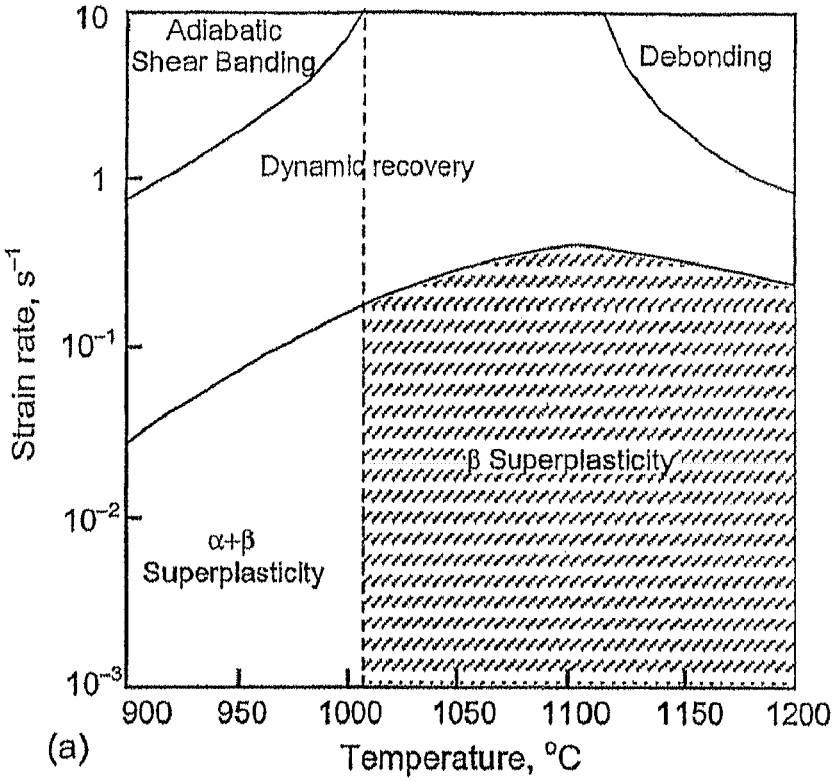
FIG. 12 Microstructural mechanism map for hot working of (a) Ti-6AI-4V-1.6B and (b) Ti-6AI-4V-2.9B.
Figure 12:
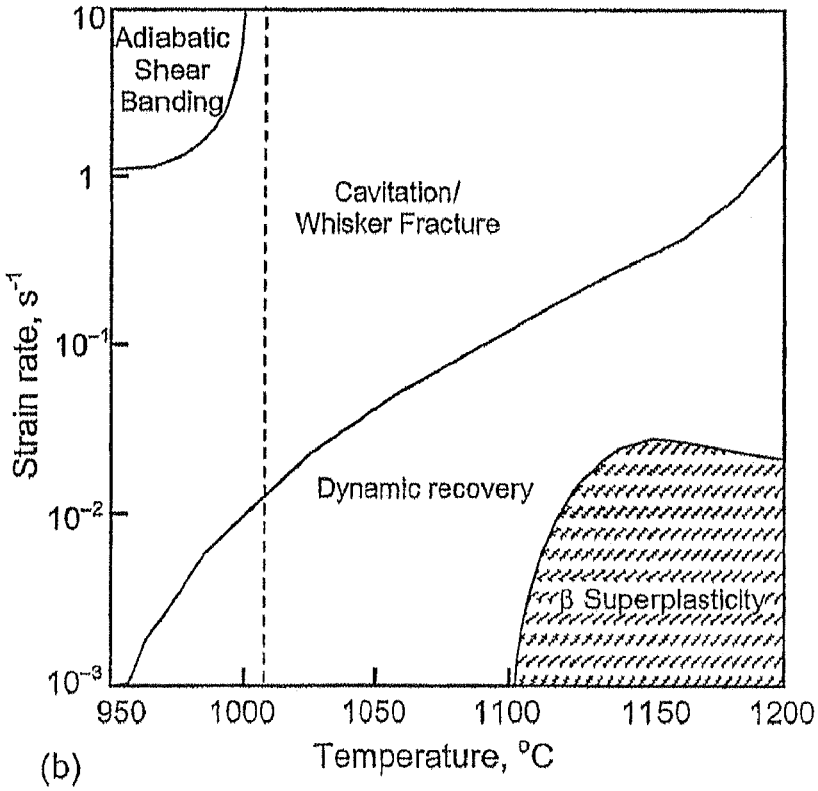

Isothermal compression tests were conducted in the temperature range 900-1200° C. and at constant strain rates in the range $10^{-3}$ $10^{s-1}$ using cylindrical specimens of 10 mm diameter and 15 mm height. Flow stresses obtained at different temperatures, strains, and strain rates were analyzed using various approaches of materials modeling [3] to identify the deformation mechanisms over the temperature and strain rate ranges studied. These mechanisms are validated with detailed microstructural observations conducted on the deformed specimens. On the basis of these analyses, microstructural mechanism maps for hot working of Ti-6Al-4V with 1.6B and 2.9B were developed and are shown in FIGS. 12(*a*) and 12(*b*), respectively. Superplasticity in the β phase field has been identified in both of the boron modified Ti-6Al-4V alloys. The superplasticity domain occurs not only at higher temperatures in the β region, but also extends to higher strain rates (up to $10^{-1}$ $s^{-1}$) as compared to the conventional strain rates for superplasticity in titanium alloys (Table 1).

TABLE 1

Examples of titanium alloys exhibiting superplasticity [1]

| Alloy | Beta Transus (° C.) | Superplasticity Parameters: Temperature (° C.) | Strain Rate ($s^{-1}$) | Elongation (%) |
|---|---|---|---|---|
| Ti—6Al—4V | 1000 | 840-870 | $1.3 \times 10^{-4}$-$10^{-3}$ | 750-1170 |
| Ti—6Al—2Sn—4Zr—2Mo | 1000 | 900 | $2 \times 10^{-4}$ | 538 |
| Ti—5Al—2.5Sn | 1090 | 1000 | $2 \times 10^{-4}$ | 420 |
| Ti—5Al—1Fe | 1000 | 800 | $10^{-3}$ | 800 |
| Ti—8Mn | 800 | 750 | $10^{-3}$ | 150 |
| CP Ti | 900 | I 850 | $1.7 \times 10^{-4}$ | 115 |

Superplasticity predominantly occurs by the mechanism of grain boundary sliding which requires that a fine grain size is maintained at the deformation temperature. Boron addition to titanium alloys provides a stable fine grain size in the beta phase field via effective pinning of the grain boundaries by the TiB precipitates, which enables grain boundary sliding under right combinations of deformation temperature and strain rate. The grain compatibility during grain boundary sliding is maintained by concurrent accommodation process such as diffusion that is anomalously high in the β phase field of titanium alloys.

The method described herein is a method of modifying conventional or novel titanium alloys to produce and retain a fine-grained microstructure in the monolithic beta phase field, thereby enabling superplasticity during deformation under specific temperature-strain rate combinations. Retention of this fine grain size enables superplastic forming of conventional or novel titanium alloys in the beta phase field, so that both lower press forces and higher strain rates are achieved. This advancement is achieved by the addition of controlled levels of boron to conventional or novel titanium alloys. The specific combinations of temperature and strain rate that will produce the optimum superplastic response described here will vary for each alloy composition, starting microstructure and specific metalworking process employed. As seen in the two compositions discussed, the superplasticity domain extends to different temperature and strain rate limits, depending on the boron content, the TiB precipitate size, and the starting grain size, which in turn depend on the processing method employed to produce the alloy. Hence, the strain rate and temperature parameters will need to be optimized for each specific composition and the starting microstructure to achieve beta superplasticity in titanium alloys. Additions of boron as low as 0.01% to titanium alloys causes formation of TiB precipitates which could enable superplasticity at high temperatures and high strain rates depending on the influence of these precipitates on the thermo-mechanical response of the alloy. The amount of boron to be added to enable beta superplasticity in titanium alloys depends on the composition of the alloy and processing conditions, which is optimized for reproducing the methods described herein.

Validation Experiments

Figure 13:
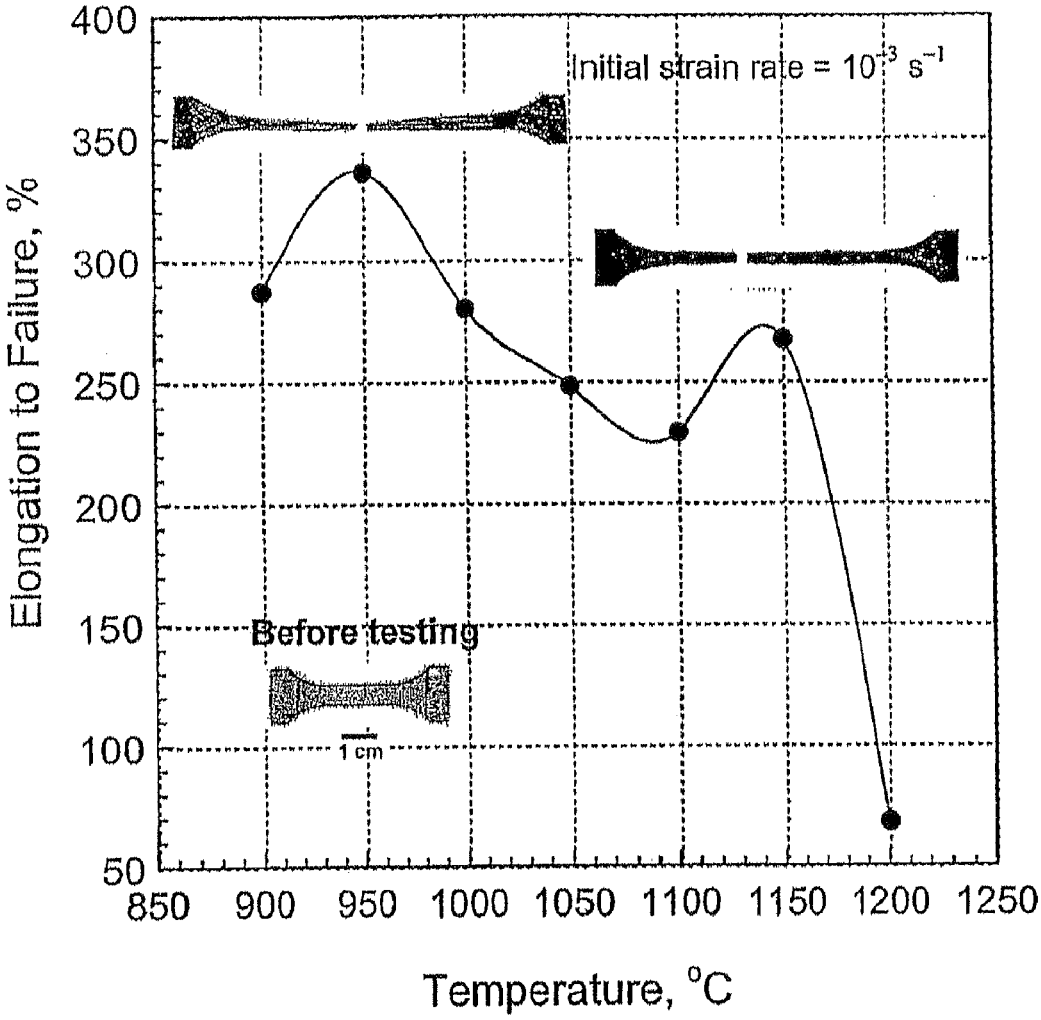
FIG. 13 Variation of tensile elongation to failure with temperature for Ti-6AI-4V-1.6B produced by the prealloyed powder method.
Figure 14:
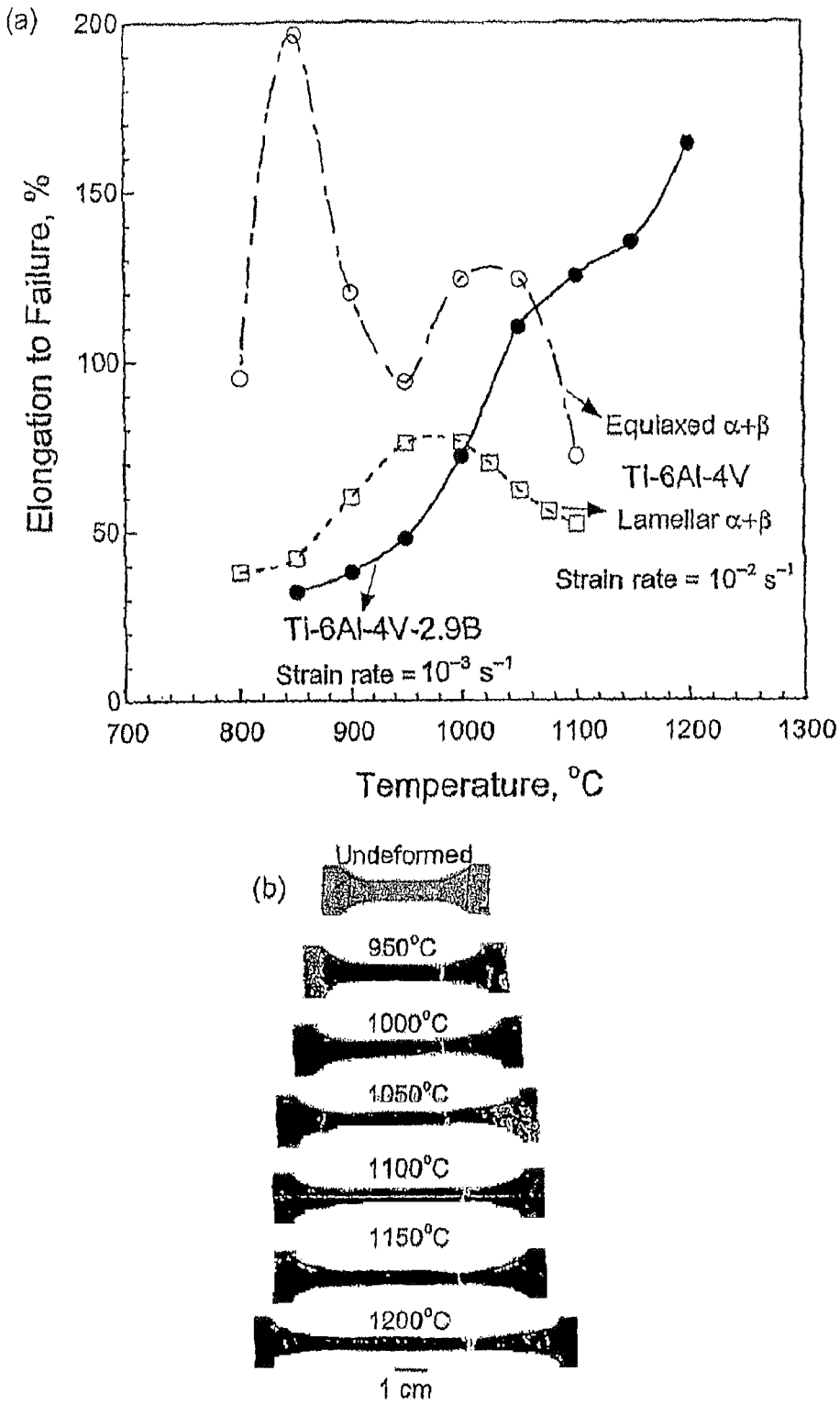
FIG. 14 (a) Variation of tensile elongation to failure with temperature for Ti-6AI-4V2.9B produced by the blended powder method and Ti-6AI-4V having lamellar and equiaxed starting microstructures. (b) photographs of Ti-6AI4V-2.9B tensile specimens before and after deformation.
Figure 15:
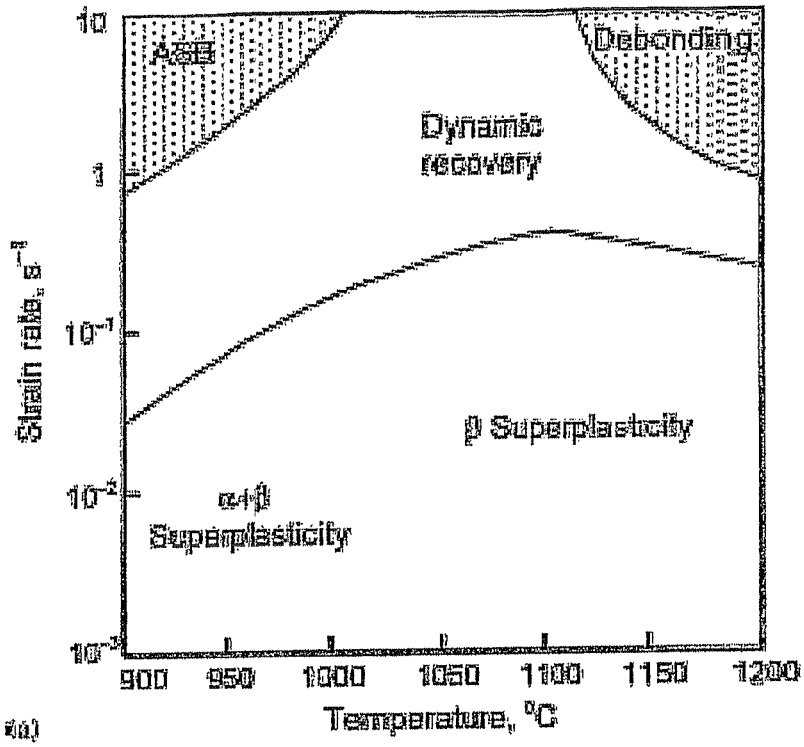
FIG. 15 (a) The processing map for hot working of Ti-6Al-4V-1.6B compact (equivalent TiBw volume fraction=10%) produced by the pre-alloyed powder approach in the ranges 900-1200° C. and $10^{-3}$ to 10 $s^{-1}$, (b) Processing map for hot working of Ti-6Al-4V-2.9B compact (equivalent $TiB_w$ volume fraction 20%) produced by blending of powders.
Figure 15:
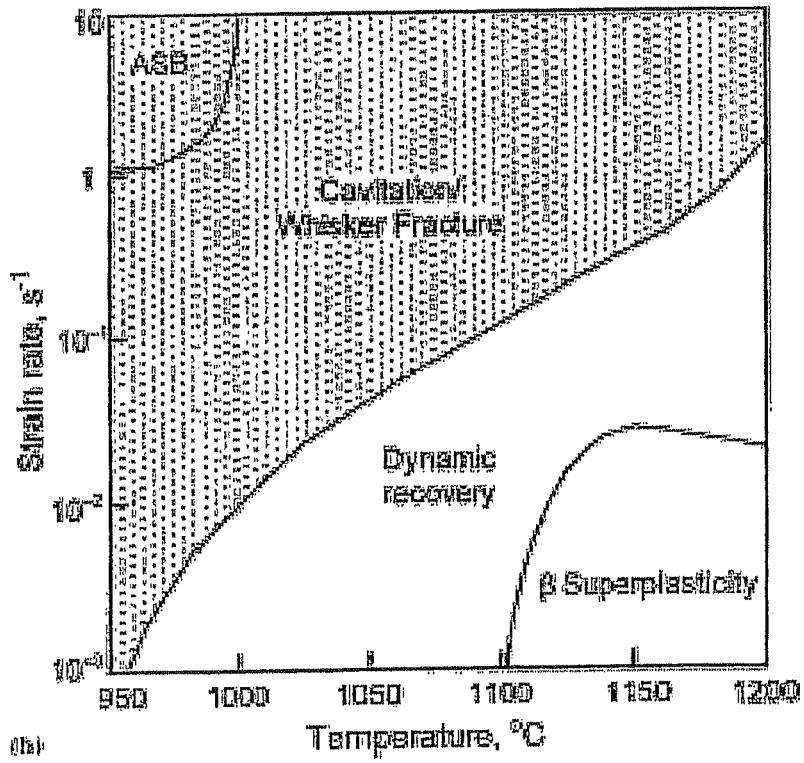

Superplasticity is typically characterized by large elongations (~200%) in tension. To validate the occurrence of superplasticity in the beta phase, hot tensile tests were conducted using flat dog bone shaped specimens at a starting strain rate of $10^{-3}$ $s^{-1}$ and different temperatures, for both of the alloy compositions. Variation of the elongation to failure with temperature for Ti-6Al-4V-1.6B and specimen photographs are shown in FIG. 13. Elongations as high as 270% were recorded in the beta phase field at 1150° C., confirming the claimed (3 superplasticity. FIG. 14 presents the elongation as a function of temperature for Ti-6Al-4V-2.9B as compared with the conventional Ti-6Al-4V alloy without boron in two different starting microstructural conditions, viz., lamellar and equiaxed [4]. While both the Ti-6Al-4V starting microstructures show a rapid drop in elongation with increasing temperature above the beta transus, Ti-6Al-4V-2.9B exhibits increasing elongation with increasing temperature above the beta transus, with the highest elongation of 164% achieved at 1200° C. These validation experiments demonstrate that superplasticity could be enabled at high strain rates in the beta phase field by the addition of boron to titanium alloys and deforming under specific temperature-strain rate conditions.

The ability to achieve superplasticity in the β phase field of titanium alloys enables forming of intricate shapes not possible by any other approach.

The ability to form superplastically in the beta phase field reduces the material flow stress significantly which can be advantageously used to perform forming operations using moderate capacity presses and low cost dies. The other advantages include uniform metal flow, reduced machining, no resultant residual stresses, and no springback.

Processing in the beta phase field improves the chemical homogeneity due to enhanced diffusion rates.

The occurrence of beta superplasticity at higher strain rates than the conventional practices reduces the processing times significantly and improves the affordability of titanium alloy component manufacturing.

The versatility of the superplastic forming process for titanium can be enhanced by combining it with diffusion bonding (solid state joining).

Ti—B Alloys

Titanium alloys modified with small additions of boron are emerging as potential candidates for replacing structural components requiring high specific stiffness and strength at room as well as moderately elevated temperatures. The property enhancements are through the formation of fine, dispersed TiB precipitates. These precipitates in the boron-modified alloys are whiskers (TiBw) formed in situ in the titanium matrix, which distribute uniformly and discontinuously and provide nearly isotropic properties, reaction-free interface, and ease of workability. Recent advances in synthesizing techniques enable cost-effective production of these alloys. A variety of techniques such as conventional casting, powder metallurgy, rapid solidification, and mechanical alloying have been used to produce these materials, and the final microstructural characteristics (e.g., grain size and morphology, TiB size, morphology, and distribution) sensitively depend on the processing method. Deformation processing is not only an essential step in the shape-forming of engineering components, but also causes significant modifications in the microstructure and a wide range of enhanced mechanical property combinations can be obtained in these materials. In this section, deformation processing of the most important Ti alloy Ti-6Al-4V modified with boron prepared by two different powder metallurgy approaches is discussed.

The processing map for hot working of Ti-6Al-4V-1.6B compact (equivalent TiBw volume fraction=10%) produced by the pre-alloyed powder approach in the ranges 900-1200° C. and $10^{-3}$ to 10 $s^{-1}$ is presented in the FIG. 12(*a*). The map reveals that at slow strain rates in the α+β range, Ti-6Al-4V-1.6B exhibits superplasticity marked by large elongations to failure and the behavior is very similar to Ti-6Al-4V. A peak ductility of 335% was recorded at 950° C. (initial strain rate=$10^{-3}$ $s^{-1}$), which is the optimum temperature for superplastic forming this alloy. In the β phase field Ti-6Al-4V-1.6B also exhibits superplastic behavior with moderately high elongations (peak ductility of 250% at 1150° C.). The presence of $TiB_w$ enables β superplasticity by stabilizing fine grain size, which otherwise rapidly grows to the order of few mm in Ti-6A1-4V. Grain boundary sliding as well as α or β/$TiB_w$ interfacial sliding, with simultaneous diffusional accommodation are found to contribute to the superplasticity mechanisms. At high strain rates (>1 $s^{-1}$), Ti-6Al-4V-1.6B exhibits adiabatic shear banding at temperatures below 1000° C. and cavitation at the interfaces above 1150° C., and these processing conditions should be avoided.

Processing map for hot working of Ti-6Al-4V-2.9B compact (equivalent $TiB_w$ volume fraction 20%) produced by blending of powders is shown in FIG. 12(*b*). Ironically, the safe processing window for deformation processing of this alloy is very restricted. The only region to hot work this alloy is in the β phase field at slow strain rates where the deformation mechanism is either superplasticity or dynamic recovery, which is similar to Ti-6Al-4V-1.6B. A large regimen of instability manifested in the form of cavitation at the $TiB_w$ ends, leading to whisker fracture in some instances occurs. The intensity of these defects increases with increase in strain rate and decrease in temperature. The key differences between Ti-6Al-4V-2.9B and Ti-6Al-4V-1.6B are increased volume fraction of TiB, coarser TiB size, and coarse a grain size in the former. The occurrence of cavitation and whisker fracture in Ti-6Al-4V-2.9B is attributed to insufficient accommodation of the stresses generated at the rigid $TiB_w$ by the matrix flow. Therefore, care should be taken while processing boron-modified Ti alloys by taking into account the microstructural characteristics.

The examples provided herein are for illustrative purposes only and are not meant to limit the scope of the claims in any way.

The invention claimed is:

1. A method for achieving beta-phase superplasticity in titanium alloys, the method comprising:

preparing a microstructural mechanism map for a boron-containing titanium alloy, selecting beta-phase strain rates and temperature from the prepared microstructural mechanism map, deforming the boron-containing titanium alloy under the selected beta-phase strain rates and temperatures;

wherein the boron-containing titanium alloy is Ti-6Al-4V-XB, wherein X is in the range of from 0.01% to 18.4% by weight.

2. The method of claim 1 wherein X is in the range from 1.6% to 2.9% by weight.

3. A method for achieving beta-phase superplasticity in titanium alloys, the method comprising the steps of:

a) forming a boron-containing titanium alloy;

b) preparing a microstructural mechanism for the allo c) selecting beta-phase strain rates and temperatures from the prepared microstructural mechanism map; and d) deforming the boron-containing titanium alloy under the selected beta-phase strain rates and temperatures determined in step c);

wherein the boron-containing titanium alloy is Ti-6Al-4V-XB, wherein X is in the range of from 0.01% to 18.4% by weight.

4. The method of claim 3 wherein the boron is added to the titanium alloy in a liquid state, wherein the boron is dissolved in the liquid titanium alloy.

5. The method of claim 3 wherein the boron is added to the titanium alloy through intermixing of a boron-containing powder and a titanium-containing powder.

6. The method of claim 3 wherein the boron is selected from the group consisting of elemental boron, $TiB_2$, or a boron-containing alloy.

7. The method of claim 3 wherein X is in the range from 1.6% to 2.9% by weight.

* * * * *